US012023568B2

(12) United States Patent
Olaoluwa

(10) Patent No.: US 12,023,568 B2
(45) Date of Patent: Jul. 2, 2024

(54) WEIGHTED BOXING AND EXERCISE GLOVE WITH IMPROVED DURABILITY

(71) Applicant: Oluwaseun Olaoluwa, Toronto (CA)

(72) Inventor: Oluwaseun Olaoluwa, Toronto (CA)

( * ) Notice: Subject to any disclaimer, the term of this patent is extended or adjusted under 35 U.S.C. 154(b) by 284 days.

(21) Appl. No.: 17/712,092

(22) Filed: Apr. 2, 2022

(65) Prior Publication Data

US 2022/0226716 A1 Jul. 21, 2022

Related U.S. Application Data

(63) Continuation-in-part of application No. 16/949,138, filed on Oct. 15, 2020, now abandoned.

(51) Int. Cl.
*A63B 71/14* (2006.01)

(52) U.S. Cl.
CPC ..... *A63B 71/145* (2013.01)

(58) Field of Classification Search
CPC ..... A63B 71/145; A63B 2209/00; A63B 2209/10; A63B 21/4019; A63B 21/065
See application file for complete search history.

(56) References Cited

U.S. PATENT DOCUMENTS 2,011,362 A * 8/1935 Hayward ..... A63B 71/146 473/59
4,034,979 A * 7/1977 Wester ..... A63D 5/00 473/59
4,247,097 A * 1/1981 Schwartz ..... A63B 21/065 2/160
4,330,120 A * 5/1982 Netti ..... A63B 21/065 2/160
4,556,215 A 12/1985 Tarbox
4,813,079 A * 3/1989 Reitzel ..... A63B 71/146 2/160
4,911,433 A * 3/1990 Walker ..... A63B 21/065 2/161.1
D348,090 S * 6/1994 Riley, Jr. ..... D29/116.1
5,575,008 A * 11/1996 McBride ..... A41D 19/01523 2/161.1
5,768,710 A * 6/1998 Williams ..... A63B 21/065 2/163
5,820,526 A * 10/1998 Hoffman ..... A63B 21/065 482/55
5,924,136 A * 7/1999 Ogean ..... A45C 11/182 2/163
6,013,044 A * 1/2000 Estwanik ..... A41D 19/01582 602/61
6,553,574 B1 * 4/2003 Hall, Jr. ..... A63B 21/065 2/160
6,990,689 B1 1/2006 Thellmann
8,312,567 B1 11/2012 Valle
8,572,764 B2 11/2013 Thellmann
(Continued)

FOREIGN PATENT DOCUMENTS

WO WO-2012140390 A1 * 10/2012 ..... A63B 21/00065

*Primary Examiner* — Nyca T Nguyen
(74) *Attorney, Agent, or Firm* — Boris Lechinsky

(57) ABSTRACT

A weighted boxing and exercise glove includes a pouch for insertion of a weighted block inside thereof, wherein the pouch is located within a padding layer of the glove and separated from both the external glove material and the internal glove material by a suitable thickness of the padding material so as to reduce the risk of cuts, cracks, or rupture during boxing exercises.

9 Claims, 2 Drawing Sheets

(56) References Cited

U.S. PATENT DOCUMENTS

| | | | | |
|---|---|---|---|---|
| D718,396 | S * | 11/2014 | Whitmore | D21/683 |
| 9,844,693 | B2 * | 12/2017 | Jones | A63B 21/065 |
| 10,806,194 | B1 | 10/2020 | Tyson | |
| 2002/0128126 | A1 | 9/2002 | Cook | |
| 2003/0092544 | A1 | 5/2003 | Reed | |
| 2011/0088131 | A1 * | 4/2011 | McVan | A63B 69/26 2/18 |
| 2011/0277205 | A1 * | 11/2011 | Cuadrado | A41D 19/01523 2/18 |
| 2011/0301001 | A1 * | 12/2011 | Hopper | A63B 21/4019 482/121 |
| 2012/0100966 | A1 * | 4/2012 | Chen | A63B 69/26 482/83 |
| 2012/0117704 | A1 * | 5/2012 | Hofeldt | A41D 19/01523 2/20 |
| 2012/0144554 | A1 | 6/2012 | Thellmann | |
| 2014/0031180 | A1 * | 1/2014 | Jones | A63B 69/26 482/111 |
| 2015/0119200 | A1 * | 4/2015 | Jones | A63B 21/0607 482/44 |
| 2017/0001097 | A1 * | 1/2017 | Ferrer | A41D 19/01523 |
| 2019/0060697 | A1 | 2/2019 | Nicely | |
| 2019/0281902 | A1 * | 9/2019 | Nabors | A63B 71/141 |
| 2021/0016153 | A1 * | 1/2021 | Roddy | A41D 19/0044 |

* cited by examiner

WEIGHTED BOXING AND EXERCISE GLOVE WITH IMPROVED DURABILITY

CROSS-REFERENCE DATA

This application is a continuation-in-part of the co-pending U.S. patent application Ser. No. 16/949,138 filed Oct. 10, 2020 entitled "Boxing gloves with pouch (pocket) as fitness apparatus and exercise tool", which is incorporated herein by reference in its entirety.

BACKGROUND

Without limiting the scope of the invention, its background is described in connection with weighted exercise gloves. More particularly, the invention describes a weighted boxing and exercise glove with improved durability for a variety of training exercises.

Weighted hand gloves have been used in a variety of contexts. U.S. Pat. Nos. 6,279,163; 4,911,433; and 4,830,360 describe weighted gloves that include weights positioned at various points along the hand portion of the glove, including on the back of the hand and on the fingers. Other types of weighted gloves for use as exercise gloves are disclosed in the following U.S. Pat. Nos. 6,553,574; 4,923,418; 4,330,120; 3,124,806; 2,011,362; and 889,397. These gloves likewise employ weights located on the back of the user's hand and, while potentially useful for certain fitness purposes, for the glove to provide meaningful exercise to the arms and chest, the user may prefer weights that are heavier than those that can be easily supported by the hand or fingers alone. In this case, locating of the weight in the pockets external to the outer glove surface may cause rupture and failure of the glove.

Typical boxing exercises involve punching of a target with the hand of the user protected by the glove. Most of the punching load is on the external, back-of-the-hand and the front surface of the glove above the fingers. Most prior art devices teach locating one or more weights in various pockets attached to these external surfaces of the glove. Vigorous exercise would be likely to cause damage to the glove from the internal weights directly subjected to these punching loads.

The need exists therefore for a novel weighted glove capable of withstanding wear during vigorous boxing and fitness exercise for a long time.

SUMMARY

Accordingly, it is an object of the present invention to overcome these and other drawbacks of the prior art by providing a novel weighted glove adapted for various exercise activities.

It is another object of the present invention to provide a weighted glove capable of withstanding wear and tear at significant levels with improved durability.

It is a further object of the present invention to provide a weighted exercise glove allowing the user to vary the level of additional weight associated with the glove so as to broaden the extent of boxing and other fitness activities available for the wearer of the product.

In one aspect or embodiment of the present invention, a weighted boxing and exercise glove is provided for the user. The glove includes a back-of-a-hand portion located between four finger openings and a back edge of the glove, wherein the four finger openings are configured to allow a wearer to insert a pinky finger, a ring finger, a middle finger, and an index finger therein respectively.

The back-of-a-hand portion includes a continuous layer of external glove material such as leather or artificial leather facing outwards and extending from the four finger openings towards the back edge of the glove. A wrap-around fastener is present at the back edge of the glove and configured for securing the glove tightly to the wrist of the wearer. A padding layer of suitable thickness is present between the continuous layer of external glove material and a layer of an internal glove material.

The back-of-a-hand portion of the glove further features an internal pouch located within the padding layer. One side of the pouch has a pouch opening extending along one side of the glove. The pouch opening has a zipper or another pouch closure configured to provide a closable access to the pouch along the entire length of the pouch. The pouch with its side pouch opening is configured for inserting and removing of a weighted block, which can be adjusted depending on the particular exercise needs of the wearer. Once inserted into the pouch, the weighted block is to be fully positioned inside the pouch and separated from the external glove material and the internal glove material by a layer of padding material.

To avoid rips of the external glove material, the continuous layer thereof on the back-of-the hand portion of the glove has no other attachments that are sewn, stapled, or otherwise attached thereto, such as additional pockets, or any other accessories or alike. This is done to prevent damage of the external glove material during use.

As a result, lack of any attachment to the external glove layer and positioning the pouch with the weighted block within the padding layer and away from the continuous layer of external glove material by at least 5 mm of padding material improves durability of the glove during boxing and exercise use.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF PREFERRED EMBODIMENTS OF THE INVENTION

Figure 1:
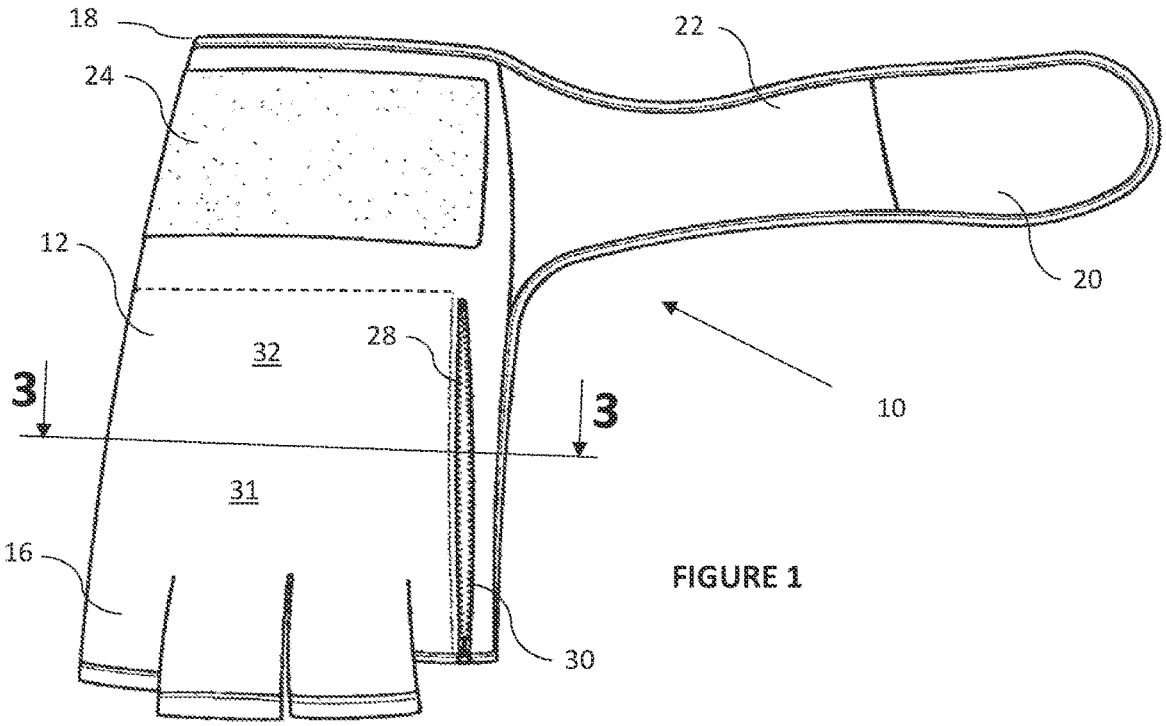
FIG. 1 is a top view of the weighted glove of the invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Figure 2:
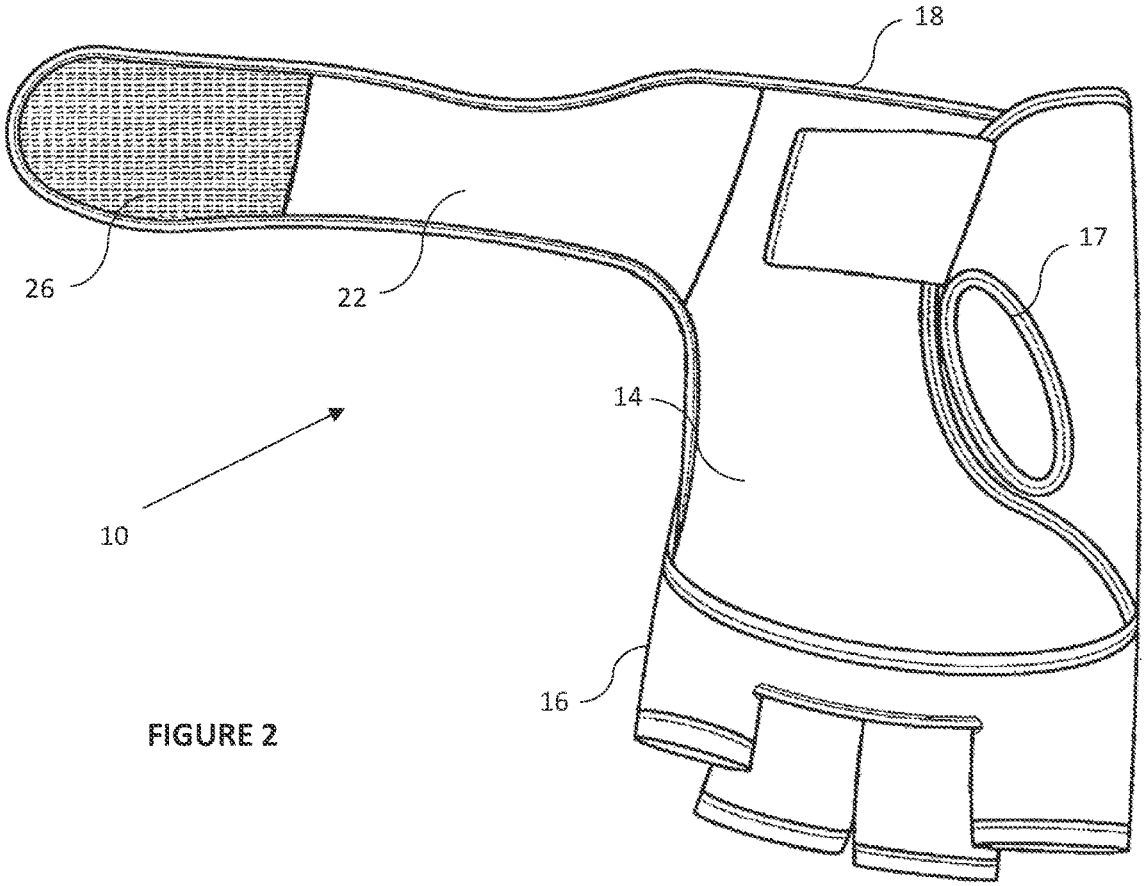
FIG. 2 is a bottom view of the same.

FIGS. 1 and 2 show the novel weighted glove 10 of the present invention. It features a back-of-a-hand portion 32 located between four finger openings 16 and a back edge 18 of the glove, wherein the four-finger openings 16 are configured to allow a wearer to insert a pinky finger, a ring finger, a middle finger, and an index finger therein respectively. A separate thumb opening 17 is located appropriately on a side portion of the glove 10. The back edge 18 further features a wrap-around fastener comprising a side strap 22 with a closure 20 configured for securing the glove 10 to the wrist of the wearer by wrapping the strap 22 around thereof and attaching the closure 20 to the top portion of the glove. In one example, a Velcro™ closure may be used, with hooks area 26 attached to the loops area 24. One advantage of using the Velcro™ closure is the ability to adjust the wrap-around fastener to various sizes of the wearer's wrists. However, other known closure attachments may also be used as the invention is not limited in this regard.

The inner layer 14 may be made from soft leather or fabric as it is facing the skin of the back-of-the-hand part of the wearer's hand. Microfiber, polyurethane, vinyl, or other materials may also be used as the invention is not limited in this regard.

The back-of-a-hand portion 32 includes a continuous layer 12 of external glove material facing outwards and extending from the four-finger openings 16 towards the back edge 18 of the glove 10. One of the key innovations of the present invention is the absence of any attachments to the continuous layer 12 in the area which is expected to absorb a punch when the glove is used for boxing exercises. This is done to improve the durability of the glove 10 as the presence of these attachments (such as pockets, compartments, etc.) causes stress concentration on the points of attachment to the continuous layer during exercise and leads to premature cracks, rips, and other failures.

Various durable materials may be used for the continuous layer 12. Natural cow or buffalo leather, such as top or full grain leather may be a premier choice for the continuous layer 12. Suitable thickness may be selected to improve durability further, such as at least 0.5 mm, at least 1 mm, or greater. Alternative material choices include microfiber, polyurethane, or vinyl.

A cushioning padding layer 40 of suitable thickness is present between the continuous layer 12 of external glove material and a layer of the internal glove material 14. The padding layer may include horsehair padding, foam padding, or a combination thereof. Foam padding may be made from a cushioning latex, PVC, or polyurethane foam configured to function as a shock absorber. In further embodiments, a layered approach to the padding content of the glove 10 may be used—with different areas of the glove having different stiffness or foam density of the padding layers. In one example, a higher density foam may be positioned around the knuckles compared to the lower density foam positioned about the back-of-the-hand portion of the glove.

In further embodiments, gel padding may be used in combination with other padding materials. The gel padding layer may be configured to dissipate impacts of punching more evenly throughout the glove which can improve hand protection.

Figure 3A:
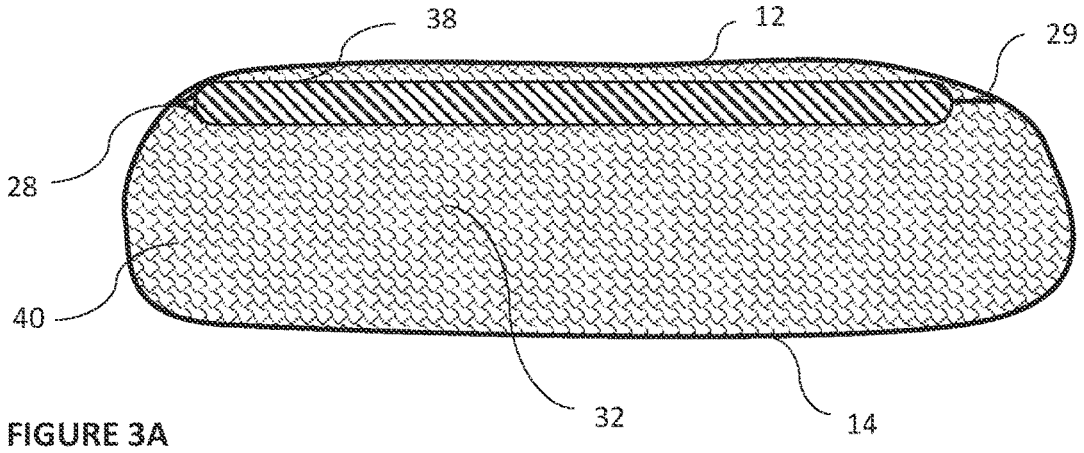
FIG. 3A is a cross-section as shown in FIG. 1 showing the position of the pouch with the weighted block withing the padding material and near the external glove material.
Figure 3B:
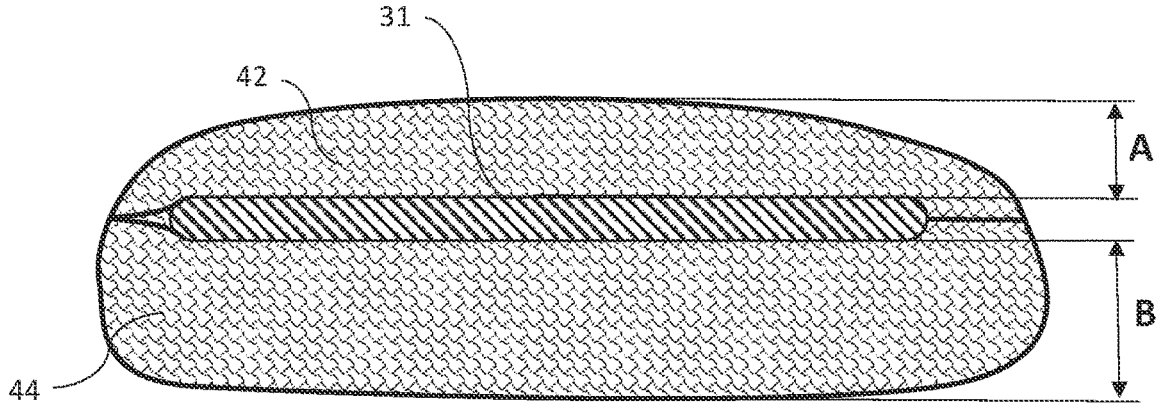
FIG. 3B is a cross-section as shown in FIG. 1 showing the position of the pouch with the weighted block withing the padding material inbetween the internal glove material and the external glove material.
Figure 3C:
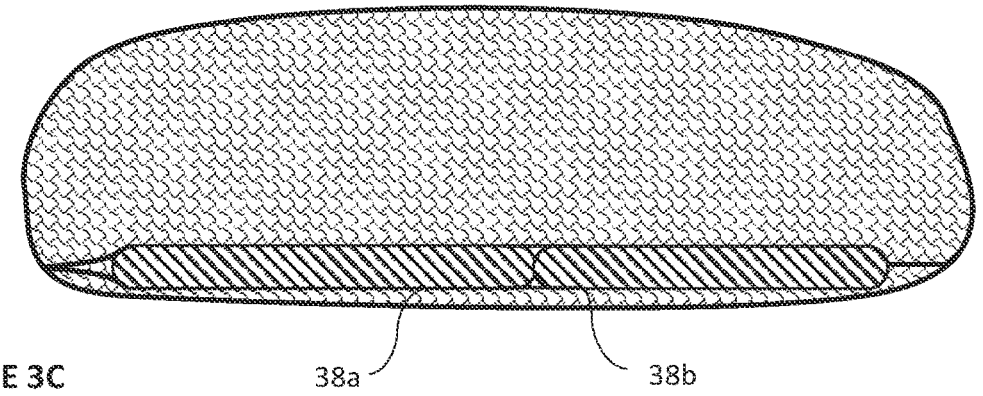
FIG. 3C is a cross-section as shown in FIG. 1 showing the position of the pouch with the weighted block withing the padding material and near the internal glove material.

To improve the versatility of the glove for use during a variety of exercises, the glove 10 is equipped with an internal pouch 31 located within the padding layer 40 on the back-of-the-hand portion 32. One side of the pouch 31 has a pouch opening 30 extending along one side of the glove 10 at a location that is not likely to encounter any punches during exercise. The side pouch opening 30 has a zipper or another pouch closure configured to provide a closable access to pouch 31 along the entire length thereof. The pouch 31 may be made from fabric, mesh, or a polymer film of suitable thickness. The pouch 31 with its side pouch opening is configured for inserting and removing of a weighted block 38, which can be adjusted depending on the particular exercise needs of the wearer. Once inserted into the pouch 31, the weighted block 38 is fully positioned inside the pouch 31 and separated from the external glove material 12 and the internal glove material 14 by at least one layer of padding material 40. Both sides 28 and 29 of the pouch 31 may remain flat following the insertion of the weighted block 38 as seen in FIGS. 3A to 3C.

The weighted block 38 may be a single solid piece of metal (such as brass, steel, aluminum, or any other suitable metal, which may have rounded edges to reduce the risk of internal rupture or cut during exercise. In other embodiments, the weighted block 38 may comprise two or more adjacent pieces 38*a* and 38*b* as seen in FIG. 3C. Such pieces may be the same or have dissimilar shapes to allow the wearer to adjust the additional weight as desired. The total additional weight of two weighted blocks for a pair of the right glove and the left glove may be in a range from 0.5 lbs to 3.5 lbs, such as at least 0.5 lbs, at least 1 lb, at least 1.5 lbs, at least 2 lbs, at least 2.5 lbs, at least 3 lbs, at least 3.5 lbs, or even higher as the invention is not limited in this regard.

The depth of location of the pouch 31 within the padding layer 40 is important to achieve the high durability of the glove 10. Various suitable arrangements are seen in examples in FIGS. 3A, 3B, and 3C. To protect the continuous layer 12 from the risk of internal cuts and rips caused by the presence of the weighted block 38 nearby as a result of vigorous exercise, the minimum depth A of the upper padding layer 42 between the weighted block and the continuous layer 12 may be at least 5 mm or more—see FIG. 3A. On the other side, positioning the weighted block 38 too close to the inner layer 14 may cause hand trauma when the wearer makes a hard punch with the glove 10. To avoid that risk, the minimum thickness B of the lower internal padding layer 44 may be selected to be at least 5 mm or more. In embodiments, either one or both of the thicknesses A and B of the respective padding layers may be at least 5 mm, at least 10 mm, at least 15 mm, at least 20 mm, at least 25 mm, at least 30 mm, at least 35 mm, at least 40 mm, at least 45 mm, at least 50 mm, at least 55 mm, at least 60 mm, or more as the invention is not limited in this regard.

Furthermore, thicknesses A and B of the padding layer 40 may not be even. In one example, the thickness A may be about half of the thickness B so as to better protect the hand of the wearer. In other embodiments, thickness A may comprise from 10 to 80 percent of the entire thickness of the padding layer 40, such as at least 10 percent, at least 20 percent, at least 30 percent, at least 40 percent, at least 50 percent, at least 60 percent, at least 70 percent, or at least 80 percent of the total thickness of the padding 40, which in turn may be in a range from about 10 mm to about 70 mm as the invention is not limited in this regard.

In use, the wearer has an option to use the glove 10 without any additional weights or to insert one or more weighted blocks to make the glove 10 heavier. Once the pouch closure is zipped up, the weighted block 38 is isolated and located inside the pouch and within the padding layer 40. Vigorous exercise using the glove 10 may be accomplished without a risk of rupture, cut, or crack of the continuous layer 12 of external glove material caused by the presence of the weighted block 38 inside the glove 10.

In further embodiments, the pouch 31 may be located between two layers of the padding material, wherein the material or density of the upper padding layer 42 is different from the material or density of the lower padding layer 44. In one example, the upper padding layer may be made from a higher density foam as compared to the material of the lower padding layer 44.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein, Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered dose enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A weighted boxing and exercise glove comprising a back-of-a-hand portion thereof located between four finger openings and a back edge of the glove, the four finger openings are configured to allow a wearer to insert a pinky finger, a ring finger, a middle finger, and an index finger therein respectively, the back-of-a-hand portion comprising a continuous layer of external glove material facing outwards and extending from the four finger openings towards the back edge of the glove, the back-of-a-hand portion further comprising an internal pouch located within a padding layer located underneath the continuous layer of glove material, the pouch is equipped with a pouch opening extending along a side of the glove, the pouch opening has a pouch closure configured to provide a closable access to the pouch along the entire length of the pouch for inserting and removing of a weighted block to be positioned inside the pouch, the continuous layer of external glove material over the pouch on the back-of-the hand portion of the glove has no other attachments thereto to prevent damage thereof during use, wherein the continuous layer of external glove material is separated from the pouch by at least 5 mm of padding layer to improve durability of the glove during boxing and exercise use.

2. The weighted boxing and exercise glove as in claim 1, wherein the pouch is located between an upper padding layer and a lower padding layer, wherein the material or density of the upper padding layer is different from the material or density of the lower padding layer.

3. The weighted boxing and exercise glove as in claim 2, wherein the upper padding layer between the pouch and the continuous layer of external glove material is made from a higher density foam in comparison to the material of the lower padding layer between the pouch and the layer of internal glove material.

4. The weighted boxing and exercise glove as in claim 1, wherein the padding layer separating the pouch from the continuous layer of external glove material has a thickness of at least 10 mm.

5. The weighted boxing and exercise glove as in claim 1, wherein the padding layer separating the pouch from the continuous layer of external glove material has a thickness of at least 15 mm.

6. The weighted boxing and exercise glove as in claim 1, wherein the padding layer separating the pouch from the continuous layer of external glove material has a thickness of at least 20 mm.

7. The weighted boxing and exercise glove as in claim 1, wherein the padding layer separating the pouch from the continuous layer of external glove material has a thickness of at least 10 percent of the thickness of the entire padding layer separating the continuous layer of external glove material from a layer of internal glove material.

8. The weighted boxing and exercise glove as in claim 1, wherein the padding layer separating the pouch from the continuous layer of external glove material has a thickness of at least 20 percent of the thickness of the entire padding layer separating the continuous layer of external glove material from a layer of internal glove material.

9. The weighted boxing and exercise glove as in claim 1, wherein the padding layer separating the pouch from the continuous layer of external glove material has a thickness of at least 30 percent of the thickness of the entire padding layer separating the continuous layer of external glove material from a layer of internal glove material.

* * * * *